US006400919B1

(12) United States Patent
Inoue et al.

(10) Patent No.: US 6,400,919 B1
(45) Date of Patent: Jun. 4, 2002

(54) CONDUCTING MEMBER, PROCESS CARTRIDGE AND IMAGE-FORMING APPARATUS

(75) Inventors: Hiroshi Inoue, Kamakura; Naoki Fuei, Odawara, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/672,993

(22) Filed: Sep. 29, 2000

(30) Foreign Application Priority Data

Sep. 30, 1999 (JP) ..... 11-280195

(51) Int. Cl.[7] ..... G03G 15/02

(52) U.S. Cl. ..... 399/176; 361/225; 399/174; 492/56

(58) Field of Search ..... 399/176, 174, 399/303, 313, 149, 150; 361/221, 225; 492/53, 56

(56) References Cited

U.S. PATENT DOCUMENTS 4,851,960 A 7/1989 Nakamura et al. ..... 361/225
RE35,581 E 8/1997 Nakamura et al. ..... 361/225
5,822,169 A * 10/1998 Yoshioka et al. ..... 361/225
6,134,407 A * 10/2000 Ishiyama et al. ..... 399/174
6,270,449 B1 * 8/2001 Hirayama ..... 492/56 X
6,312,792 B1 * 11/2001 Okada et al. ..... 399/176 X

FOREIGN PATENT DOCUMENTS

JP 63-149669 6/1988
JP 10-254217 9/1998
JP 10-307454 * 11/1998
JP 10-307459 * 11/1998

* cited by examiner

*Primary Examiner*—Sophia S. Chen
(74) *Attorney, Agent, or Firm*—Fitzpatrick, Cella, Harper & Scinto

(57) ABSTRACT

A conducting member is disposed in contact with an electrophotographic photosensitive member to which a voltage is to be applied and includes a support and a coating layer formed on the support. The coating layer contains a conducting agent having been subjected to surface treatment and the surface of the conducting member has a coefficient of static friction of 1.0 or lower.

28 Claims, 4 Drawing Sheets

CONDUCTING MEMBER, PROCESS CARTRIDGE AND IMAGE-FORMING APPARATUS

BACKGROUND OF THE INVENTION

1. Field of the Invention

This invention relates to a conducting member which electrically controls contact object members such as charging members, developer-carrying members, transfer members, cleaning members and charge-eliminating members which are used in image-forming apparatus such as printers, facsimile machines and copying machines employing electrophotographic processes, and to a process cartridge and an image-forming apparatus which make use of such a conducting member.

2. Related Background Art

Charging processes in electrophotographic processes have conventionally widely employed a corona charging assembly with which the surface of a charging object member, electrophotographic photosensitive member is uniformly charged to a stated polarity and potential by a corona shower generated by applying a high voltage (DC voltage of 6 to 8 kV) to a metal wire. However, there have been problems such that it requires a high-voltage power source and ozone is generated in a relatively large quantity.

As a countermeasure thereto, a contact charging system in which a voltage is applied while a charging member is brought into contact with a photosensitive member to charge the surface of the photosensitive member has been put into practical use. This is a system in which a roller type, blade type, brush type or magnetic brush type conducting member (charging member) serving as an electric-charge feed member is brought into contact with a photosensitive member and a stated charging bias is applied to this contact charging member to uniformly charge the photosensitive member surface to a stated polarity and potential.

This charging system has advantages that power sources can be made low-voltage and the generation of ozone can be lessened. In particular, a roller charging system employing a conductive roller (charging roller) as the contact charging member is preferably used in view of the stability of charging. With regard to the uniformity of charging, however, it is a little disadvantageous over the corona charging assembly.

In order to improve charging uniformity, as disclosed in Japanese Patent Application Laid-open No. 63-149669, an "AC charging system" is used in which an alternating voltage component (AC voltage component) having a peak-to-peak voltage which is at least twice the charge-starting voltage ($V_{TH}$) is superimposed on a DC voltage corresponding to the desired charging object surface potential Vd and a voltage thus formed (pulsating voltage; a voltage whose value changes periodically with time) is applied to the contact charging member. This system aims at the potential-leveling effect attributable to AC voltage. The potential of the charging object member converges on the potential Vd which is the middle of the peak of the AC voltage, and is not affected by any external disorder of environment or the like. Thus, this is a good contact charging method.

Since, however, a high-voltage AC voltage, having a peak-to-peak voltage, which is at least twice the discharge-starting voltage ($V_{TH}$) at the time DC voltage, is superimposed thereon, an AC power source is required in addition to the DC power source. This causes the apparatus to have a high cost. Moreover, since AC current is consumed in a large quantity, there has been a problem that the running performance of the charging roller and the photosensitive member tends to decline.

These problems can be solved by applying only DC voltage to the charging roller to effect charging. However, the application of only DC voltage to the charging roller has caused the following problems.

The application of only DC voltage to a conventional charging member may cause the charging member to undergo deterioration by electrification as a result of continuous use, tending to cause an increase in resistance (charge-up) of the charging member, especially in an environment of low humidity, concurrently resulting in a decrease in the charge potential of the charging object member surface having been subjected to charging.

When images are continuously reproduced on many sheets using a conventional charging roller causing such a problem, by means of, e.g., an image-forming apparatus employing a reversal development system, there has been a problem that images after continuous many-sheet reproduction have a lower image quality than images at the initial stage.

To cope with this problem, a technique is proposed as disclosed, e.g., in Japanese Patent Application Laid-open No. 10-254217, in which a conducting agent subjected to silane coupling treatment is incorporated in a surface layer of a charging member so that any change in resistance of the charging member, which is caused by oxygen or by oxidation of conducting agents due to moisture content, can be made smaller. This publication, however, has no disclosure concerning any measure to perform charging in a low-humidity environment. It has been sought to provide a conducting member that may cause much less of a change in resistance.

In the image-forming apparatus employing the contact charging system, uneven image density may also occur because of faulty charging due to contamination of the charging member (adhesion of developer to its surface) to tend to cause a problem with running performance. Accordingly, in order to enable many-sheet printing, it has been a pressing need to prevent the influence of faulty charging due to contamination of the charging member. Especially in the case of the DC charging system where only the DC voltage is applied to the charging member, the influence of the contamination of the charging member tends to cause more faulty images than in the case of the AC charging system.

SUMMARY OF THE INVENTION

The present invention was made taking account of the foregoing. Accordingly, an object of the present invention is to provide a conducting member which may hardly cause an increase in resistance of the conducting member and can maintain a good charging performance over a long period time even when the charging object member is charged by applying only DC voltage to the charging member, and to provide a process cartridge and an image-forming apparatus which make use of such a conducting member.

Another object of the present invention is to provide a conducting member which does not cause any faulty charging due to contamination of a conducting member and can maintain a good charging performance over a long period of time, and to provide a process cartridge and an image-forming apparatus which make use of such a conducting member.

To achieve the above objects, the present invention provides a conducting member which is disposed in contact with an electrophotographic photosensitive member and to which a voltage is to be applied, the conducting member comprising:

a support and a coating layer formed on the support;

the coating layer containing a conducting agent having been subjected to surface treatment, and the surface of the conducting member having a coefficient of static friction of 1.0 or lower.

The present invention also provides a process cartridge comprising:

an electrophotographic photosensitive member and a conducting member disposed in contact with the electrophotographic photosensitive member and to which a voltage is to be applied, the electrophotographic photosensitive member and conducting member being supported as one unit and being detachably mountable to the main body of an electrophotographic apparatus, the conducting member comprising a support and a coating layer formed on the support;

the coating layer containing a conducting agent having been subjected to surface treatment, and the surface of the conducting member having a coefficient of static friction of 1.0 or lower.

The present invention still also provides an image-forming apparatus comprising:

an electrophotographic photosensitive member and a conducting member disposed in contact with the electrophotographic photosensitive member and to which a voltage is to be applied, the conducting member comprising a support and a coating layer formed on the support, the coating layer containing a conducting agent having been subjected to surface treatment, and the surface of the conducting member having a coefficient of static friction of 1.0 or lower.

DETAILED DESCRIPTION OF THE PREFERRED EMBODIMENTS

The conducting member of the present invention is a member which is disposed in contact with an electrophotographic photosensitive member and to which a voltage is to be applied. It comprises a support and a coating layer formed on the support. The coating layer contains a conducting agent having been subjected to surface treatment, and the surface of the conducting member has a coefficient of static friction of 1.0 or lower.

Figure 1:
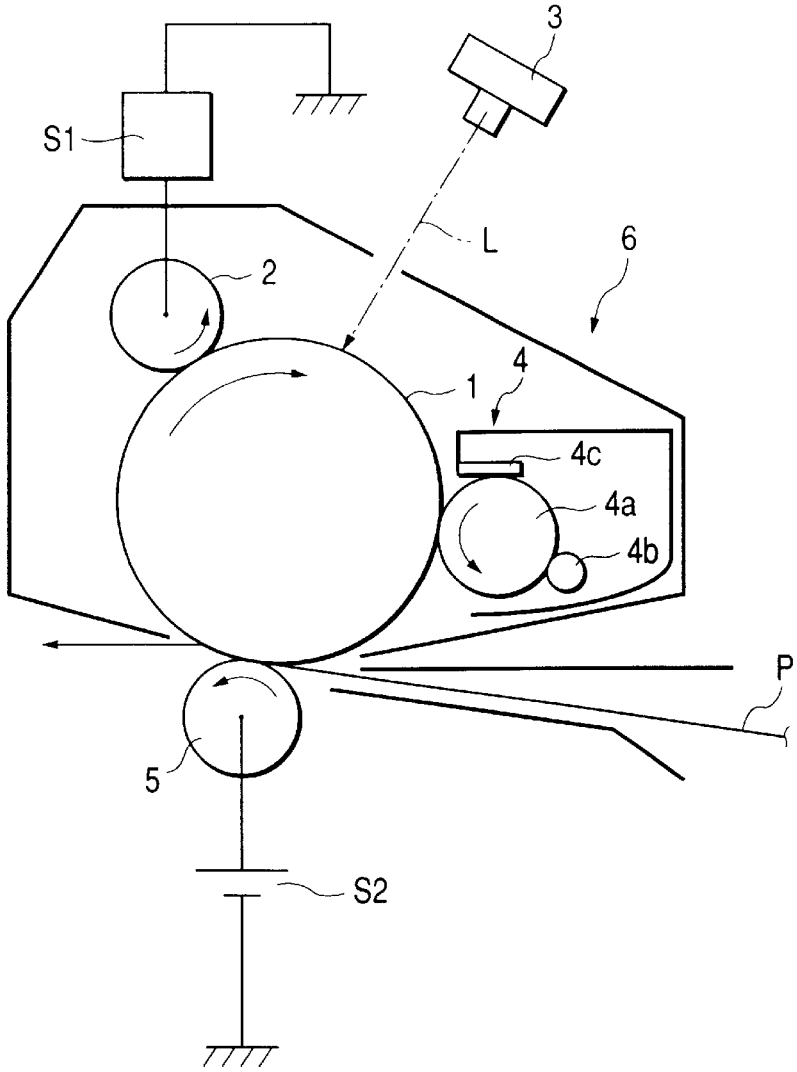
FIG. 1 is a schematic illustration of the construction of an image-forming apparatus having the process cartridge of the present invention.

In the present invention, the use of a specific conducting agent and the setting of the coefficient of static friction of the surface to such a specific value act cooperatively. This not only enables control of changes in resistivity of the conducting member, but also makes any contaminants hardly adhere to the conducting member surface, so that any faulty charging due to contamination of the conducting member does not occur and very good images can be obtained. The present invention is very effective for making it possible to carry out many-sheet printing in, in particular, image-forming apparatus employing what is called the cleaning-at-development (cleanerless) system, which, as shown in FIG. 1, has no dependent cleaning means and the toner having remained on the photosensitive member after transfer is collected by a developing means.

The mechanism of the present invention is still unclear, but extensive studies made by the present inventors have elucidated the following.

First, it has been found that, when a surface layer is formed by coating, hydrophobic treatment of a conducting agent to be incorporated in the surface layer makes its affinity for coating material solvents higher to improve dispersibility of the conductive agent to endow coating films with good surface properties, and this influences the coefficient of static friction and is also advantageous for preventing adhesion of contaminants.

It has also been found that the changes in resistivity during continuous use of a conducting member depend on at least the surface state (hydrophilicity or hydrophobicity) of the conducting agent. For example, in the case when a conducting member is incorporated with a hydrophilic conducting agent, the resistance has been found to tend to increase as a result of continuous use of the conducting member. Especially in an environment of low temperature and low humidity, the conducting member causes a great increase in resistance. Then, in order to lessen the increase in resistance that is caused by continuous use of the conducting member, it has been found to be effective to use as a conducting agent of the conducting member a conducting agent having been subjected to hydrophobic treatment.

The mechanism by which the resistance increases during continuous use of conducting members is unclear. It is presumed that the increase in resistance that is caused when the surface layer is incorporated with a hydrophilic conducting agent causes polarization or the like because of electrification of hydrophilic groups at the surface of the conducting agent, resulting in charge-up to lose the conductive function required as a conducting agent.

It has been considered that, especially in the environment of low temperature and low humidity, the conducting member might tend to be affected by electrification because no water is present around hydrophilic groups. Thus, it is considered that, the part undergoing the charge-up can be lessened by making hydrophobic treatment to break up hydrophilic groups, and hence the resistance does not increase even when the conducting member is continuously used (continuously electrified).

Various studies made as stated above have used the conducting member of the present invention as a charging member having superior stability or durability of charging, which has a surface layer incorporated with a conducting agent having been subjected to hydrophobic treatment and the surface of which has a coefficient of static friction of 1.0 or lower.

The image-forming apparatus of the present invention is constructed as outlined below.

(1) Image-forming Apparatus

FIG. 1 is a schematic illustration of the construction of the image-forming apparatus of the present invention having the process cartridge of the present invention. The image-forming apparatus of this example is an apparatus of a reverse development system and of a cleaning-at-development (cleanerless) system, employing transfer type electrophotography.

Reference numeral 1 denotes a rotating drum type electrophotographic photosensitive member serving as an image bearing member, which is rotatingly driven in the direction of an arrow at a stated peripheral speed (process speed).

Reference numeral 2 denotes a charging roller (the conducting member of the present invention) serving as a means for charging an electrophotographic photosensitive member 1, which is kept in contact with the electrophotographic photosensitive member 1 under a stated pressure. In this example, the charging roller 2 is driven, and is rotated at a speed equal to the electrophotographic photosensitive member 1. A stated DC voltage (in this case, set at −1,300 V) is applied to this charging roller 2 from a charging bias-applying power source S1. Thus the surface of the electrophotographic photosensitive member is uniformly charged to a stated polarity and potential (set at a dark-area potential of −700 V) by a contact charging and DC charging system.

Reference numeral 3 denotes an exposure means, which is, e.g., a laser beam scanner. Of the electrophotographic photosensitive member 1, the surface to be charged is exposed to light L corresponding to the intended image information, which is exposed through an exposure means 3, so that the surface potential of the electrophotographic photosensitive member is lowered (attenuates) selectively to the potential at exposed light areas (set at a light-area potential of −120 V) and an electrostatic latent image is formed.

Reference numeral 4 denotes a reverse developing means, where a toner (a negative toner) standing charged (development bias: −350 V) to the same polarity as the charge polarity of the electrophotographic photosensitive member is made to adhere selectively to the exposed light areas of the electrostatic latent image on the electrophotographic photosensitive member to render the electrostatic latent image visible as a toner image. In FIG. 1, reference numeral 4*a* denotes a developing roller; 4*b* denotes a toner feed roller; and 4*c* denotes a toner-layer-thickness regulation member.

Reference numeral 5 denotes a transfer roller as a transfer means, which is kept in contact with the electrophotographic photosensitive member 1 under a stated pressure to form a transfer zone, and is rotated in the forward direction of the rotation of the electrophotographic photosensitive member at a peripheral speed substantially equal to the peripheral speed of the rotation of the electrophotographic photosensitive member. Also, a transfer voltage having the polarity opposite to the charge polarity of the toner is applied from a transfer bias-applying power source S2. A transfer medium P is fed at a stated controlled timing from a paper feed mechanism section (not shown) to the transfer zone, and the back side of the fed transfer medium P is charged to a polarity opposite to the charge polarity of the toner by means of a transfer roller 5 having a transfer voltage, whereby the toner image on the electrophotographic photosensitive member 1 is electrostatically transferred to the transfer medium P.

The transfer medium P to which the toner image has been transferred at the transfer zone is separated from the surface of the electrophotographic photosensitive member, and is guided into a toner image fixing means (not shown), where the toner image is subjected to fixing. Then the image-fixed transfer medium is outputted as an image-formed matter. In the case of a double-side image-forming mode or a multiple-image-forming mode, this image-formed matter is guided into a recirculation delivery mechanism (not shown) and is again guided to the transfer zone.

Residues on the electrophotographic photosensitive member, such as transfer residual toner, are charged by the charging roller 2 to the same polarity of the charge polarity of the electrophotographic photosensitive member. Then, the transfer residual toner is passed through the exposure zone to reach the developing means 4, where it is electrostatically collected in the developing apparatus by back contrast to accomplish the cleaning-at-development (cleanerless cleaning).

In this example, the electrophotographic photosensitive member 1, the charging roller 2 and the developing means 4 are supported as one unit to set up a process cartridge 6 which is detachably mountable to the main body of the electrophotographic apparatus. Here, the developing means 4 may be set as a separate assembly.

(2) Conducting Member

Figure 2:
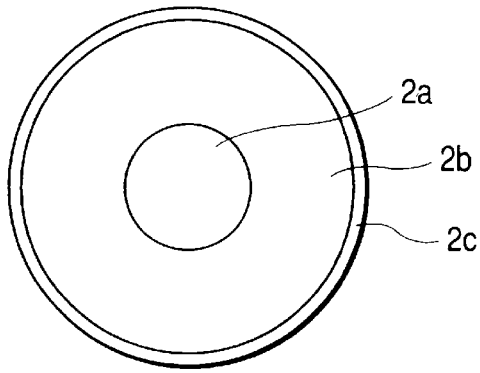
FIG. 2 is a schematic illustration of a charging roller.

The conducting member has, e.g., the shape of a roller as shown in FIG. 2, and is constituted of a conductive support 2*a* and as covering layers an elastic layer 2*b* integrally formed on its periphery and a surface layer 2*c* formed on the periphery of the elastic layer 2*b*.

Figure 3A:
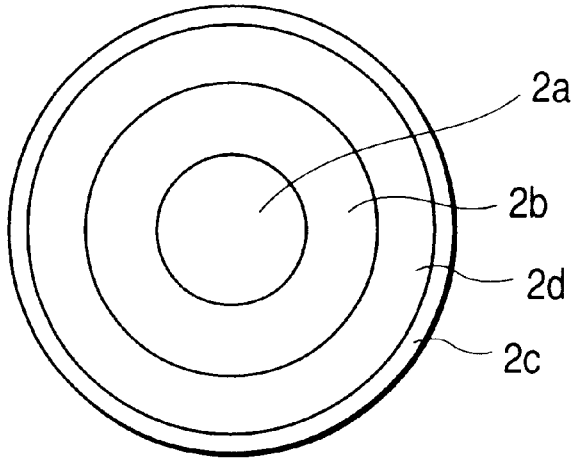
FIGS. 3A and 3B are schematic illustrations of charging rollers showing different examples.
Figure 3B:
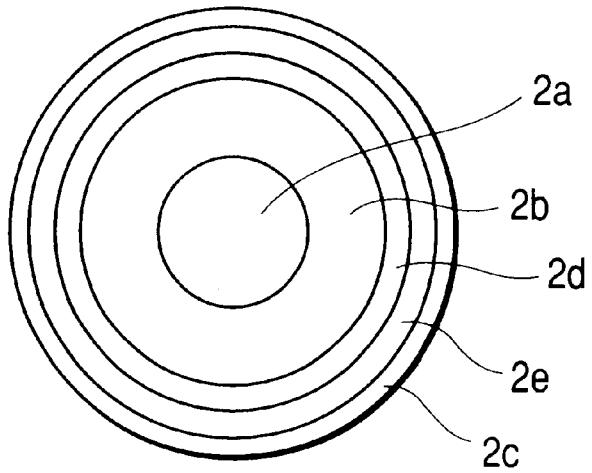

Other constitution of the conducting member (charging roller) of the present invention is shown in FIGS. 3A and 3B. As shown in FIG. 3A, the conducting member may have three layers consisting of an elastic layer 2*b*, a resistance layer 2*d* and a surface layer 2*c* or, as shown in FIG. 3B, may be so made up that at least four layers are formed on the conductive support 2*a* as covering layers, which are provided with a second resistance layer 2*e* between the resistance layer 2*d* and the surface layer 2*c*.

As the conductive support 2*a* used in the present invention, a round rod of a metallic material such as iron, copper, stainless steel, aluminum or nickel may be used. The surface of any of these metals may further be plated for the purpose of anti-corrosion or impartment of resistance to scratches, but must not damage conductivity.

In the charging roller 2, the elastic layer 2*b* is endowed with appropriate conductivity and elasticity in order to supply electricity to the electrophotographic photosensitive member 1 serving as the charging object member and to ensure a good uniform close contact of the charging roller 2 with the electrophotographic photosensitive member 1. Also, in order to ensure the good uniform close contact of the charging roller 2 with the electrophotographic photosensitive member, the elastic roller 2*b* may also preferably be so abraded as to be formed into what is called a crown, which is a shape having the largest diameter at the middle and diameters made smaller toward both ends. Since a charging roller 2 commonly used is brought into contact with the electrophotographic photosensitive member 1 under application of a stated pressure on both ends of the support 2*a*, the pressure is low at the middle and is larger toward both ends. Hence, there is no problem as long as the charging roller 2 has a sufficient straightness. If, however, it has an insufficient straightness, it may cause an uneven density in images between those corresponding to the middle and both ends. It is formed into the crown in order to prevent this.

The elastic layer 2*b* may have a conductivity adjusted to below $10^{10}$ Ω·cm by appropriately adding in an elastic material such as rubber a conducting agent having an electron-conducting mechanism, such as carbon black, graphite or a conductive metal oxide, and a conducting agent having an ion-conducting mechanism, such as an alkali metal salt or a quaternary ammonium salt. Specific elastic materials for the elastic layer 2*b* may include, e.g., natural rubbers, synthetic rubbers such as ethylene-propylene rubber (EPDM), styrene-butadiene rubber (SBR), silicone rubber, urethane rubber, epichlorohydrin rubber, isoprene rubber (IR), butadiene rubber (BR), nitrile-butadiene rubber (NBR) and chloroprene rubber (CR), and may further include polyamide resins, polyurethane resins and silicone resins.

In the charging member to which only a DC voltage is applied to charge the charging object member, medium-resistance polar rubbers (e.g., epichlorohydrin rubber, NBR, CR and urethane rubber) or polyurethane resins may particularly preferably be used as elastic materials in order to achieve uniform charging performance. These polar rubbers and polyurethane resins are considered to have a conductivity, though slight, as the water content or impurities in rubber or the resin act(s) as a carrier, and the conducting mechanism of these is considered to be ion conduction. However, conducting members (charging members) obtained by forming the elastic layer without adding the conducting agent at all to any of these polar rubbers and polyurethane resins have a high resistivity, which is as high as $10^{10}$ Ω·cm or above in a low-temperature and low-humidity (L/L) environment. Hence, it becomes necessary to apply a high voltage to such conducting members.

Accordingly, the above conducting agent having an electron-conducting mechanism or conducting agent having an ion-conducting mechanism may preferably be added to adjust the conductivity so that the conducting member can have a resistivity below $10^{10}$ Ω·cm in an L/L environment. The conducting agent having an ion-conducting mechanism, however, has a small effect of lowering resistivity, which effect is small especially in an L/L environment. Accordingly, in combination with the addition of the conducting agent having an ion-conducting mechanism, the conducting agent having an electron-conducting mechanism may auxiliarily be added to adjust the resistivity. When, however, the elastic layer is the surface layer, the conducting agent must be one having been surface-treated.

Foams obtained by blowing these elastic materials may also be used in the elastic layer 2*b*.

The resistance layer 2*d* (2*e*) is formed at a position adjoining to the elastic layer, and hence it is provided in order to prevent a softening oil, a plasticizer or the like contained in the elastic layer, from bleeding out to the conducting member (charging member) surface, or to adjust electrical resistance of the whole conducting member (charging member).

Materials constituting the resistance layer used in the present invention may include, e.g., epichlorohydrin rubber, NBR, polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene-vinyl acetate type thermoplastic elastomers, polyvinyl chloride type thermoplastic elastomers and chlorinated polyethylene type thermoplastic elastomers. Any of these materials may be used alone, may be a mixture of two or more types, or may form a copolymer.

The resistance layer 2*d* (2*e*) used in the present invention must have conducting properties or semiconducting properties. To exhibit conducting or semiconducting properties, various conducting agents having an electron-conducting mechanism (such as conductive carbon, graphite, conductive metal oxides, copper, aluminum, nickel, iron powders, alkali metal salts and ammonium salts) or ion-conducting agents may appropriately be used. In this case, in order to attain the desired electrical resistance, such various conducting agents may be used in combination of two or more types. In the resistance layer 2*d* (2*e*) used in the present invention, a conducting agent having been surface-treated may particularly preferably be used, and, when the resistance layer is the surface layer, the conducting agent must be one having been surface-treated. The resistance layer 2*d* (2*e*) may preferably have a resistivity of from $10^4$ to $10^{12}$ Ω·cm. It may also preferably have a thickness of from 5 to 1,000 μm.

In the present invention, the surface of the conducting member may preferably have a coefficient of static friction of 1.0 or lower and 0.01 or higher, and particularly preferably 0.5 or lower. If it has a coefficient of static friction higher than 1.0, the conducting member surface may have so small a releasability that the transfer residual toner tends to adhere thereto to cause a deterioration of image quality. Such deterioration of image quality may be caused especially in a low-temperature and low-humidity environment. If it is lower than 0.1, the electrophotographic photosensitive member and the conducting member tend to slip to affect their rotational drive undesirably.

The coefficient of static friction depends on the types and mixing proportion of the materials used in the surface layer as a matter of course and also on the state of mixing of the materials. In the present invention, what is important is that the coefficient of static friction satisfies the above range, and there are no particular limitations on means by which it is materialized. However, it is preferable to use a resin having a coefficient of static friction of 0.50 or lower.

In the following, the coefficient of static friction of the surface of the conducting member is represented by $\mu s$; and the coefficient of static friction of the binder resin of the surface layer by $\mu s_B$.

In the present invention, in the selection of materials for the surface layer, the coefficient of static friction $\mu s_B$ of the binder resin is measured in the following way: A coating film of the binder resin is formed on an aluminum sheet to obtain a sample sheet measured with a static-friction coefficient measuring instrument, HEIDON TRIBOGEAR MUSE TYPE 941 (manufactured by Shinto Kagaku K. K.) to find the coefficient of static friction $\mu s_B$ of the binder resin material of the conducting member surface layer.

A conducting agent and other additive are incorporated in the material having a coefficient of static friction $\mu s_B$ of 0.50 or lower as measured by this method, to form the surface layer of the conducting member. Then, the conducting member is so material-designed that the surface has a coefficient of static friction $\mu s_B$ of 1.0 or lower as the conducting member.

Figure 5:
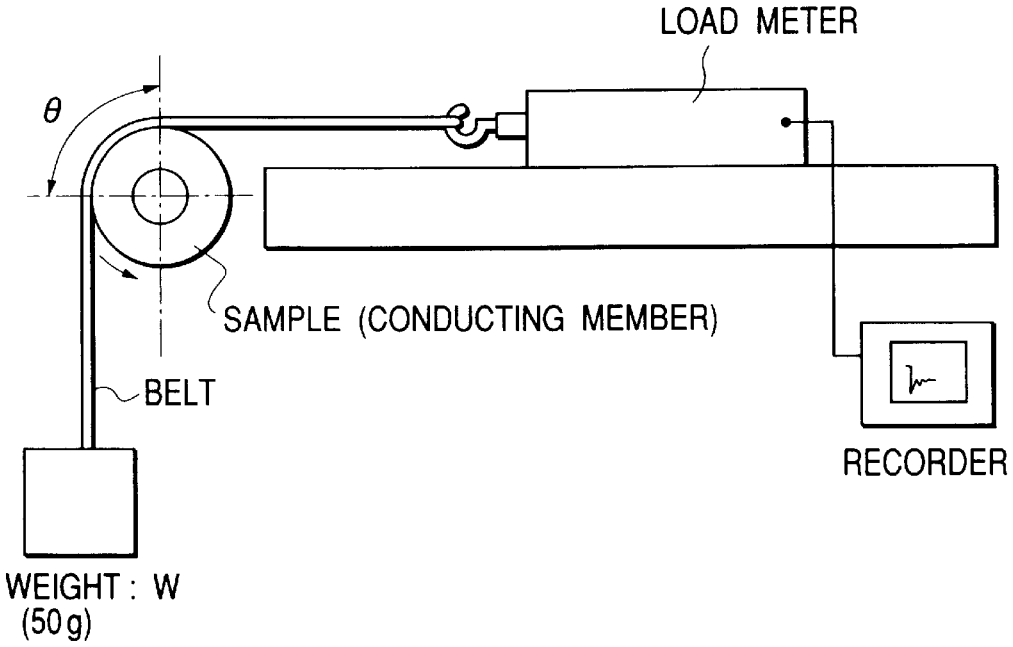
FIG. 5 is a schematic illustration of an instrument for measuring the coefficient of static friction of a conducting member.

The measurement of the coefficient of static friction $\mu s$ of the conducting member surface in the present invention is outlined in FIG. 5. This measuring method is a method suited when the measuring object has the shape of a roller, and is a method which conforms to Euler's belt equation. According to this method, a belt (20 μm thick, 30 mm wide and 180 mm long) brought into contact with the measuring object conducting member at a stated angle (θ) is connected with a measurement section (a load meter) at its one end and with a weight W at the other end. When in this state the conducting member is rotated in and at a stated direction and speed, the coefficient of friction ($\mu$) is determined by the following equation where the force measured at the measurement section is represented by F (g) and the weight of the weight by W (g):

$$\mu s=(1/\theta)\ln(F/W).$$

Figure 6:
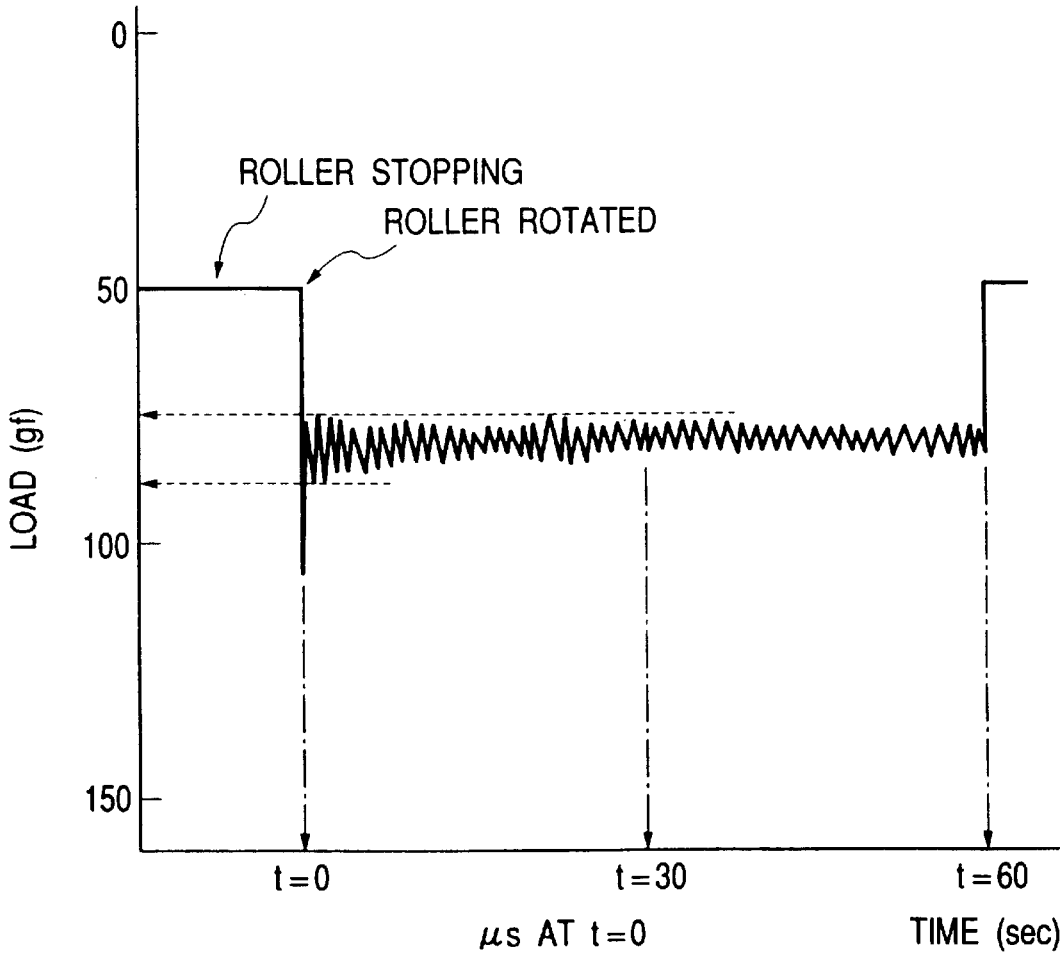
FIG. 6 is an example of a chart obtained by measurement with the static-friction coefficient measuring instrument.

An example of a chart obtained by this measuring method is shown in FIG. 6. Here, it is seen that the value obtained immediately after the conducting member is rotated indicates the force necessary to start the rotation and the value after that indicates the force necessary to continue the rotation. Hence, the force at a rotation start point (i.e., the point of time, t=0 second) can be said to be a static frictional force and also the force at an arbitrary time of 0<t (second) <60 can be said to be a dynamic frictional force at the arbitrary time. Therefore, the coefficient of static friction can be determined by:

$$\mu s=(1/\theta)\ln(F_{<t=0>}/W).$$

In this measuring method, coefficients of friction of various substances can be determined by forming the belt surface (the side coming into contact with the conducting member) using stated materials (e.g., those with which the photosensitive member outermost layer or developer is coated by a suitable means, or standard substances such as stainless steel). Namely, it would be more preferable if materials of contacting surfaces, the rotational speed, the load, and so forth are adjusted to process conditions of actual machines, but it has been found that, as a result of comparison and studies made by measuring the coefficient of friction between the conducting member and the photosensitive member and measuring the coefficient of friction between the conducting member and the stainless steel, the coefficient of friction of stainless steel may also be used. More specifically, it is generally expressed as (coefficient of friction between conducting member and photosensitive member)=K×(coefficient of friction between conducting member and stainless steel). Here, K represents a numerical value that depends on the materials or state of the photosensitive member surface, and comes to be substantially a constant value as long as the materials and surface state of the photosensitive member are the same, but may change if they differ more or less.

Hence, it is desirable for the types and mixing proportion of materials, production conditions, surface physical properties and so forth to be brought into agreement with those of an actual system. However, it is very troublesome to do so and the coefficient of friction between the conducting member and the photosensitive member and the coefficient of friction between the conducting member and the stainless steel have correlation as described above. Accordingly, in the present invention, for the sake of convenience, the coefficient of friction is measured for stainless steel (its surface has a ten-point average roughness Rz of 5 $\mu$m or smaller) and under conditions of a rotational speed of 100 rpm and a load of 50 g.

As the result of our repeated extensive studies, it has been found that controlling the conducting member surface to have the physical properties as described above ($\mu \leqq 1.0$) makes the toner hardly adhere to the conducting member surface and hence enables uniform charging even when printing a large number of sheets in total and makes no image fog occur, and also that the image fog does not occur even when printing a large number of sheets in total even in a low-temperature and low-humidity environment where image fog due to adhesion of toner tends to occur. If the coefficient of static friction $\mu$s is larger than 1.0, the conducting member surface has so small a releasability as to tend to cause adhesion of transfer residual toner, and this may cause deterioration of image quality. This tends to cause the deterioration of image quality especially in a low-temperature and low-humidity environment. Incidentally, as for the lower limit, the coefficient of static friction $\mu$s may preferably be 0.01 or higher in view of, e.g., the slip of rollers.

The surface layer 2*c* also constitutes the surface of the conducting member, and comes into contact with the charging object member photosensitive member. Hence, it must not be constituted of a material that may contaminate the photosensitive member.

Binder resin materials of the surface layer 2*c* for making the conducting member exhibit the features of the present invention may include fluorine resins, polyamide resins, acrylic resins, polyurethane resins, silicone resins, butyral resins, styrene-ethylene/butylene-olefin copolymers (SEBC) and olefin-ethylene/butylene-olefin copolymers (CEBC). As materials for the surface layer in the present invention, fluorine resins, acrylic resins and silicone resins are particularly preferred.

For the purpose of making these resins have a low coefficient of static friction, a solid lubricant such as graphite, mica, molybdenum disulfide or fluorine resin powder, or a fluorine type surface-active agent, wax, silicone oil or the like may be added.

In the surface layer, conducting agents of various types (such as conductive carbon, graphite, copper, aluminum, nickel and iron powders, and also metal oxides such as conductive tin oxide and conductive titanium oxide) may appropriately be used. In the present invention, in order to attain the desired electrical resistance, any of such various conducting agents may be used in combination of two or more types.

The conducting agent may preferably have a number-average particle diameter of from 0.001 to 1.0 $\mu$m. If it has a number-average particle diameter smaller than 0.001 $\mu$m, particles of the conducting agent tend to agglomerate to make their surface treatment difficult or may unevenly be surface-treated to make uniform treatment difficult. Those having a number-average particle diameter larger than 1.0 $\mu$m tend to affect surface roughness of the conducting member (charging member) and are not preferable.

The conducting member and the binder resin may preferably be in a proportion of from 0.1:1.0 to 2.0:1.0 in weight ratio. If the conducting member is less than 0.1, the effect attributable to the incorporation of the conducting member may be obtained with difficulty. If it is more than 2.0, the surface layer may have a low mechanical strength to make the layer brittle or high in hardness, tending to lose flexibility.

In the present invention, the conducting agent of the surface layer is characterized by having been subjected to surface treatment, and preferably to hydrophobic treatment. As hydrophobic-treating agents, preferred are coupling agents (there is no particular preference in central elements such as silicon, titanium, aluminum and zirconium), oils, varnishes, organic compounds and so forth. In particular, alkoxysilane coupling agents and fluoroalkylalkoxysilane coupling agents are preferred.

To make hydrophobic treatment of the conducting agent, two processes are available, a dry process and a wet process, in the case of, e.g., silane coupling agents.

(a) Dry Process

A silane coupling agent is sprayed or is blown in the state of vapor while the conducting agent is well agitated.

(b) Wet Process

The conducting agent is dispersed in a solvent, and a silane coupling agent also diluted in water or an organic solvent is added thereto while the both are vigorously stirred. This process is preferred for making uniform treatment. As specific methods for such silane pretreatment of conducting-agent particle surfaces, the following three methods are also available.

(1) Aqueous Solution Method

About 0.1 to 0.5% of silane is poured and dissolved in water or water-solvent having a certain pH while they are thoroughly stirred, to effect hydrolysis. A filler is immersed in the resultant solution, followed by filtration or expression to remove the water to a certain extent, and further followed by drying well at 120 to 130° C.

(2) Organic Solvent Method

Silane is dissolved in an organic solvent (alcohol, benzene or halogenated hydrocarbon) containing water in a small quantity and a solvent for hydrolysis (hydrochloric acid or acetic acid). A filler is immersed in the resultant solution, followed by filtration or expression to remove the solvent, and further followed by drying well at 120 to 130° C.

(3) Spray Method

An aqueous solution of silane or a solvent solution is sprayed while a filler is vigorously agitated, followed by drying well at 120 to 130° C.

The conducting agent may preferably have a hydrophobicity ranging from 20 to 98%, and particularly preferably from 30 to 70%. If it has a hydrophobicity lower than 20%, the conducting member (charging member) may increase in resistance to a level to be questioned when used continuously in a low-temperature and low-humidity environment, to tend to cause a decrease in charge potential of the charging object member surface. Also, if it has a hydrophobicity higher than 98%, it may become difficult to control the function (conductivity) required as the conducting agent, or pigments tend to agglomerate strongly.

The surface layer may preferably have a resistivity of from $10^4$ to $10^{15}$ Ω·cm. It may also preferably have a thickness of from 1 to 500 μm, and particularly preferably from 1 to 50 μm.

In the present invention, the conducting member may preferably have a ten-point average surface roughness Rz (JIS B0601) of 10 μm or smaller.

Where the conducting member (charging member) of the present invention is used and it has a rough surface, any unevenness of its surface may cause a delicately uneven charging if the conducting member has a rough surface, to cause faulty images consequently. There is also a possibility of attacking (e.g., abrading) the photosensitive member surface. Also, since those having a particle diameter on the order of a few μm are recently commonly used as developers (toners), there is a possibility that the developer enters concavities of the surface to cause contamination of the conducting member surface. Hence, it is more preferred for the conducting member to have a smoother surface. Stated specifically, the conducting member may preferably have a ten-point average surface roughness Rz of 10 μm or smaller, and more preferably 4 μm or smaller.

Where the conducting agent is made to have the hydrophobicity within the above range (20 to 98%), the ten-point average surface roughness Rz of the conducting member can be made small relatively with ease.

On the other hand, where a conducting agent having a hydrophobicity lower than 20% is used, the Rz may vary depending on measurement spots, or its maximum height Rmax may have a large value. This is presumably because the pigment has so low a hydrophobicity as to have a poor affinity for the solvent to provide no good dispersibility when a coating material for forming the surface layer is prepared.

Where a conducting agent having a hydrophobicity higher than 98% is used, a very fine unevenness like noise tends to appear in the roughness curve on a chart when the surface roughness of the conducting member is measured, or the ten-point average surface roughness Rz tends to have a relatively large value. This is presumably because the conducting agent agglomerates so strongly that the conducting agent agglomerates again in the step of dispersing a coating material for forming the surface layer, resulting in poor dispersion.

There are no particular limitations on the electrophotographic photosensitive member used in the present invention.

EXAMPLES

The present invention will be described below in greater detail by giving Examples.

Example 1

A charging roller as the conducting member (charging member) of the present invention was produced in the following way.

| | (by weight) |
|---|---|
| Epichlorohydrin rubber | 100 parts |
| Quaternary ammonium salt | 2 parts |
| Calcium carbonate | 30 parts |
| Zinc oxide | 5 parts |
| Fatty acid | 2 parts |

The above materials were kneaded for 10 minutes by means of an internal mixer controlled to 60° C. Thereafter, 15 parts by weight of an ether-ester type plasticizer was added, based on 100 parts by weight of the epichlorohydrin rubber, followed by further kneading for 20 minutes by means of the internal mixer, having been cooled to 20° C., to prepare a material compound. To this compound, 1 part by weight of sulfur as a vulcanizing agent and 1 part by weight of Nocceler DM (trade name; available from Ouchi-Shinko Chemical Co., Ltd.) and 0.5 part by weight of Nocceler TS as vulcanizing accelerators were added, based on 100 parts by weight of the material rubber epichlorohydrin rubber, followed by kneading for 10 minutes by means of a twin-roll mill cooled to 20° C. The resultant compound was molded by means of an extruder, which was so extruded around a stainless-steel support of 6 mm in diameter as to be in the shape of a roller. After the heating-and-vulcanizing molding, the molded product was subjected to abrasion so as to have an outer diameter of 12 mm, thus an elastic layer was formed on the support.

On this elastic layer, a surface layer as shown below was formed by coating. As a material for forming the surface layer 2*c*, an acrylpolyol was used. To 100 parts by weight of its toluene/methyl ethyl ketone (MEK) mixed solvent solution, 5 parts by weight of an isocyanate (HDI) and 8 parts by weight of hydrophobic-treated conductive tin oxide particles (number-average particle diameter: 0.03 μm) as a conducting agent were added to prepare a coating fluid (parts by weight of conducting agent/parts by weight of binder resin, P/B,=0.8/1.0). Using this coating fluid, it was coated by dip coating to form a surface layer with a layer thickness of 10 μm, thus a roller-shaped charging member (charging roller) was obtained.

As an agent for the hydrophobic treatment of the conductive tin oxide particles, ethyltrimethoxysilane was used. Also, as a method for the hydrophobic treatment of the filler, the (2) organic solvent method, described previously, was chosen.

Measurement of Hydrophobicity of Conducting Agent

To evaluate the hydrophobicity of the conducting agent, methanol titration using methanol is made in the following way: 0.2 g of fine particles (in the case of Example 1, tin oxide particles) are added to 50 ml of water held in a Erlenmeyer flask. Methanol is dropwise added from a buret. Here, the solution in the flask is continually stirred using a magnetic stirrer. Completion of settlement of the fine particles can be observed upon suspension of the whole fine particles in the liquid. The hydrophobicity is expressed as a percentage of the methanol present in the liquid mixture of methanol and water when the reaction has reached the settlement end point.

The hydrophobicity of the conductive tin oxide particles which was measured by the above method was 62%.

Measurement of Coefficient of Static Friction $\mu s_B$ of Surface Layer Material The same binder resin as that used to form the surface layer was made into a coating fluid, used as a clear coating fluid, which was then coated on an aluminum sheet to prepare a sample sheet for measuring the coefficient of static friction ($\mu s_B$).

The coefficient of static friction of this sample sheet was measured with the static-friction coefficient measuring instrument, HEIDON TRIBOGEAR MUSE TYPE 941 (manufactured by Shinto Kagaku K. K.). The coefficient of static friction $\mu s_B$ was found as an average value of measurements at five arbitrary spots on the sample sheet. The coefficient of static friction of the binder resin of the surface layer in the present Example was 0.26.

Measurement of Coefficient of Static Friction $\mu s$ of Charging Roller Surface The coefficient of static friction $\mu s$ was measured as described previously, using the measuring instrument as shown in FIG. 5. As a result, the coefficient of static friction $\mu s$ of the charging roller surface in the present Example was 0.36.

The ten-point average surface roughness Rz of the charging roller surface was 2.9 μm.

Continuous Many-sheet Image Reproduction Running Test When Only DC Voltage is Applied to Charging Roller The charging roller obtained as described above was set in the image-forming apparatus of an electrophotographic system, shown in FIG. 1, and an A4-size image with a print percentage (image area percentage) of 4% was continuously reproduced on 15,000 sheets and a halftone image was printed on every 500th sheet, in environments of environment 1 (temperature 23° C., humidity 55%), environment 2 (temperature 32.5° C., humidity 80%) and environment 3 (temperature 15° C., humidity 10%). Images were visually evaluated on whether or not any faulty images occurred which were due to the increase in resistance of the charging roller. Results obtained are shown in Table 1. Here, the image reproduction running tests were made while the applied voltage (only DC voltage) for each environment was set in such a way that the dark-area potential $V_D$ was kept at about −700 V at the initial stage of the image reproduction running test.

In Table 1, "AA" indicates that the images obtained are very good; "A" indicates they are good; "B" indicates uneven density is a little seen in halftone images; and "C" indicates uneven density and coarse images are seen in halftone images.

Figure 4:
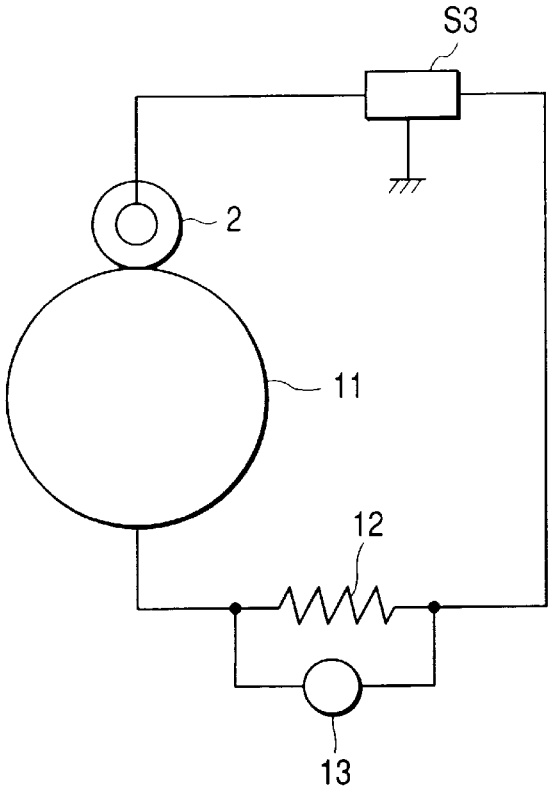
FIG. 4 is a schematic illustration of an instrument for measuring the resistance of a charging member.

Before the image reproduction running test was started (initial stage) and immediately after the continuous 15,000-sheet image reproduction was completed, the resistance of the charging roller was measured for each case in the manner as shown in FIG. 4. Results obtained are shown in Table 1 together. In FIG. 4, reference numeral 2 denotes a conducting member; 11 denotes a cylindrical electrode made of stainless steel; 12 denotes a resistance; and 13 denotes a recorder. A pressing force acting between these is set alike in the image-forming apparatus used, and the values of resistance under application of −250 V from an external power source S3 are measured.

Evaluation on Image Fog Due to Toner Adhesion onto Charging Roller

The charging roller obtained as described above was set in the image-forming apparatus of an electrophotographic system, which was the same as in used the above evaluation, and many-sheet image reproduction running tests were made in environments of environment 1 (23° C. temperature, 55* humidity), environment 2 (32.5° C. temperature, 80% humidity) and environment 3 (15° C. temperature, 10% humidity). Images obtained were visually observed to evaluate whether or not the toner adhered onto the charging roller and any fog caused by it occurred on printing paper. Stated specifically, an A4-size image with a print percentage (image area percentage) of 4% was reproduced on many sheets and a solid white image and a halftone image were printed on every 500th sheet, to make the visual observation. Results obtained are shown in Table 2.

In Table 2, "AA" indicates that the images obtained are very good; "A" denotes they are good; "B" denotes fog is seen in halftone images; and "C" denotes fog is seen in both halftone images and solid white images.

As the result, good images were obtainable from the beginning in all the environments. Even after image reproduction on 15,000 sheets, images were obtainable which were almost free of any change from those formed at the initial stage.

Example 2

A charging roller as the conducting member (charging member) of the present invention was produced in the following way.

| | (by weight) |
|---|---|
| NBR (nitrile-butadiene rubber) | 100 parts |
| Quaternary ammonium salt | 3 parts |
| Ester type plasticizer | 25 parts |
| Calcium carbonate | 30 parts |
| Zinc oxide | 5 parts |
| Fatty acid | 2 parts |

The above materials were kneaded for 10 minutes by means of an internal mixer controlled to 60° C., and thereafter further kneaded for 20 minutes by means of the internal mixer, having been cooled to 20° C., to prepare a material compound. To this compound, 1 part by weight of sulfur as a vulcanizing agent and 3 parts of Nocceler TS as a vulcanizing accelerator were added, based on 100 parts by weight of the material rubber NBR, followed by kneading for 10 minutes by means of a twin-roll mill cooled to 20° C. The resultant compound was molded by means of an extruder, which was so extruded around a stainless-steel support of 6 mm in diameter as to be in the shape of a roller.

After the heating-and-vulcanizing molding, the molded product was subjected to abrasion so as to have an outer diameter of 12 mm, thus forming an elastic layer on the support.

On this elastic layer, a surface layer as shown below was formed by coating. As a material for forming the surface layer 2*c*, polyvinyl butyral resin was used. To 100 parts of its ethanol solution (solid content: 50% by weight), 45 parts by weight of hydrophobic-treated conductive titanium oxide particles (number-average particle diameter: 0.1 μm) as a conducting agent were added to prepare a coating fluid (P/B=0.9/1.0). Using this coating fluid, it was coated by dip coating to form a surface layer with a layer thickness of 3 μm, thus obtaining a roller-shaped charging member (charging roller).

In the present Example, i-butyltrimethoxysilane was used as the hydrophobic-treating agent. Also, as the hydrophobic-treating method, the (1) aqueous solution method, described previously, was chosen. The hydrophobicity of the conductive titanium oxide particles used in the present Example was also measured by the method described previously. As the result, the hydrophobicity was 20%.

The same binder resin as that used to form the surface layer was made into a coating fluid, used as a clear coating fluid, which was then coated on an aluminum sheet to prepare a sample sheet for measuring the coefficient of static friction. The coefficient of static friction $\mu s_B$ of the binder resin of the surface layer in the present Example was measured in the same manner as in Example 1 to find that it was 0.34.

The coefficient of static friction μs of the charging roller surface in the present Example was also measured by the method as shown in FIG. 5, to find that it was 0.42. Also, the ten-point average surface roughness Rz of the charging roller surface was 1.8 μm.

Evaluation was made on this charging roller in the same manner as in Example 1 to obtain the results shown in Tables 1 and 2.

Example 3

A charging roller as the conducting member (charging member) of the present invention was produced in the following way.

| | (by weight) |
|---|---|
| Epichlorohydrin rubber | 100 parts |
| Quaternary ammonium salt | 1 part |
| Conductive carbon black | 10 parts |
| Calcium carbonate | 30 parts |
| Zinc oxide | 5 parts |
| Fatty acid | 2 parts |

The above materials were kneaded for 10 minutes by means of an internal mixer controlled to 60° C. Thereafter, 15 parts by weight of an ether-ester type plasticizer was added, based on 100 parts by weight of the epichlorohydrin rubber, followed by further kneading for 20 minutes by means of the internal mixer, having been cooled to 20° C., to prepare a material compound. To this compound, 1 part by weight of sulfur as a vulcanizing agent and 1 part by weight of Nocceler DM and 0.5 part by weight of Nocceler TS as vulcanizing accelerators were added, based on 100 parts by weight of the material rubber epichlorohydrin rubber, followed by kneading for 10 minutes by means of a twin-roll mill cooled to 20° C. The resultant compound was molded by means of an extruder, which was so extruded around a stainless-steel support of 6 mm in diameter as to be in the shape of a roller. After the heating-and-vulcanizing molding, the molded product was so abraded as to be formed into a crown having rubber-part outer diameters of 12 mm at the middle and 11.9 mm at the both ends, thus forming an elastic layer on the support.

On this elastic layer, a resistance layer as shown below was formed by coating. As a material for the resistance layer 2*d*, 100 parts by weight of epichlorohydrin rubber was dispersed and dissolved in a toluene solvent to prepare a resistance layer coating fluid. This coating fluid was coated on the elastic layer 2*b* by dip coating to form a resistance layer 2*d* with a layer thickness of 100 μm.

On this resistance layer 2*d*, a surface layer 2*c* as shown below was formed by coating. As a material for the surface layer 2*c*, a fluorine resin copolymer obtained by copolymerizing a fluoroolefin (tetrafluoride type), a hydroxyalkyl vinyl ether and carboxylic acid vinyl ester was used. To 100 parts of its ethanol solution (solid content: 50% by weight), parts of an isocyanate (HDI) and 40 parts by weight of hydrophobic-treated conductive tin oxide particles (number-average particle diameter: 0.03 μm) as a conducting agent were added to prepare a coating fluid. Using the coating fluid, it was coated by dip coating to form a surface layer with a layer thickness of 5 μm, thus obtaining a roller-shaped charging member (charging roller).

In the present Example, n-hexyltrimethoxysilane was used as the hydrophobic-treating agent. Also, as the hydrophobic-treating method, the (2) organic solvent method, described previously, was chosen. The hydrophobicity of the conductive tin oxide particles used in the present Example was 30%.

The same binder resin as that used to form the surface layer was made into a coating fluid, used as a clear coating fluid, which was then coated on an aluminum sheet to prepare a surface layer sample sheet for measuring the coefficient of static friction. The coefficient of static friction $\mu s_B$ of the binder resin of the surface layer in the present Example was 0.12.

The coefficient of static friction μs of the charging roller surface in the present Example was 0.23. Also, the ten-point average surface roughness Rz of the charging roller surface was 2.5 μm.

An evaluation was made on this charging roller in the same manner as in Example 1 to obtain the results shown in Tables 1 and 2.

Example 4

A charging roller was produced in the same manner as in Example 1 except that as the hydrophobic-treating agent the ethyltrimethoxysilane was replaced with methyltrimethoxysilane and fluoroalkylalkoxysilane [$CF_3CH_2CH_2Si(OCH_3)_3$] (weight ratio: 1:1). Evaluation was made similarly. Results obtained are shown in Tables 1 and 2. Incidentally, the hydrophobicity of the conductive tin oxide particles used in the present Example was 80%.

The coefficient of static friction $\mu s_B$ of the binder resin of the surface layer in the present Example was 0.14, and the coefficient of static friction μs of the charging roller surface was 0.24. Also, the ten-point average surface roughness Rz of the charging roller surface was 2.5 μm.

Example 5

A charging roller was produced in the same manner as in Example 4 except that as the conducting agent the tin oxide particles were replaced with titanium oxide particles (number-average particle diameter: 0.1 μm). An evaluation was made similarly. The results obtained are shown in Tables 1 and 2. Incidentally, the hydrophobicity of the conductive tin oxide particles used in the present Example was 98%.

The coefficient of static friction $\mu s_B$ of the binder resin of the surface layer in the present Example was 0.17, and the coefficient of static friction $\mu s$ of the charging roller surface was 0.27. Also, the ten-point average surface roughness Rz of the charging roller surface was 2.2 $\mu$m.

Comparative Example 1

A charging roller was produced in the following way.

| | (by weight) |
|---|---|
| EPDM (ethylene-propylene terpolymer) | 100 parts |
| Conductive carbon black | 30 parts |
| Zinc oxide | 5 parts |
| Fatty acid | 2 parts |

The above materials were kneaded for 10 minutes by means of an internal mixer controlled to 60° C., and thereafter 15 parts by weight of paraffin oil was added, based on 100 parts by weight of EPDM, followed by further kneading for 20 minutes by means of the internal mixer, having been cooled to 20° C., to prepare a material compound. To this compound, 0.5 part by weight of sulfur as a vulcanizing agent and 1 part by weight of MBT (mercaptobenzothiazole), 1 part by weight of TMTD (tetramethylthiurum disulfide) and 1.5 parts by weight of ZnMDC (zinc dimethyl dithiocarbamate) as vulcanizing accelerators were added, based on 100 parts by weight of the material rubber EPDM, followed by kneading for 10 minutes by means of a twin-roll mill cooled to 20° C. The resultant compound was molded by heating-and-vulcanizing molding by means of a press molding machine, which was so molded around a stainless-steel support of 6 mm in diameter as to be in the shape of a roller of 12 mm in diameter, thus forming an elastic layer on the support.

On this elastic layer, a resistance layer as shown below was formed by coating.

| | (by weight) |
|---|---|
| Polyurethane resin | 100 parts |
| Conductive carbon black | 15 parts |

As materials for the resistance layer 2*d*, the above materials were dispersed and dissolved in methyl ethyl ketone (MEK) to prepare a resistance layer coating fluid. This coating fluid was coated on the elastic layer 2*b* by dip coating to form a resistance layer 2*d* with a layer thickness of 100 $\mu$m.

On this resistance layer 2*d*, a surface layer 2*c* as shown below was further formed by coating.

| | (by weight) |
|---|---|
| Polyamide resin | 100 parts |
| Conductive tin oxide particles (not hydrophobic-treated; number-average particle diameter: 0.03 $\mu$m) | 10 parts |

As materials for the surface layer 2*c*, the above materials were dispersed and dissolved in a methanol/toluene mixed solvent to prepare a surface layer coating fluid. Using this coating fluid, it was coated by dip coating to form a surface layer with a layer thickness of 5 $\mu$m, thus a roller-shaped charging member (charging roller) was obtained. Incidentally, the hydrophobicity of the conductive tin oxide particles used in Comparative Example 1 was 0%.

The same binder resin as that used to form the surface layer was made into a coating fluid, used as a clear coating fluid, which was then coated on an aluminum sheet to prepare a surface layer sample sheet for measuring the coefficient of static friction. The coefficient of static friction $\mu s_B$ of the binder resin of the surface layer in Comparative Example 1 was 0.71.

The coefficient of static friction $\mu s$ of the charging roller surface was 1.03. Also, the ten-point average surface roughness Rz of the charging roller surface was 7.9 $\mu$m.

Evaluation was made on this charging roller in the same manner as in Example 1 to obtain the results shown in Tables 1 and 2.

A many-sheet image reproduction running test was also made using an image-forming apparatus making use of this charging roller. As a result, in a low-temperature and low-humidity environment (15° C. temperature, 10% humidity), faulty images caused by an increase in resistance of the charging member had occurred. Also, in the many-sheet image reproduction running test, uneven image density due to toner adhesion had occurred.

Example 6

A charging roller was produced in the same manner as in Comparative Example 1 except that 100 parts by weight of a polyurethane elastomer and 60 parts by weight of hydrophobic-treated tin oxide particles (number-average particle diameter: 0.03 $\mu$m) were used as materials for the surface layer 2*c* and methyl ethyl ketone (MEK) was used as the organic solvent.

In the present Example, a titanium coupling agent (isopropoxytitanium tristearate, TTS) was used as the hydrophobic-treating agent. The hydrophobic treatment was made in the following way. That is, tin oxide and TTS were dispersed in a toluene solvent, followed by stirring while heating at 70 to 80° C. to remove the solvent, and further followed by drying well at 120 to 130° C. Incidentally, the hydrophobicity of the conductive tin oxide particles was 15%.

The coefficient of static friction $\mu s_B$ of the binder resin of the surface layer in the present Example was 0.70, and the coefficient of static friction $\mu s$ of the charging roller surface was 0.99. Also, the ten-point average surface roughness Rz of the charging roller surface was 8.5 $\mu$m.

An evaluation was made on this charging roller in the same manner as in Example 1 to obtain the results shown in Tables 1 and 2.

A many-sheet image reproduction running test was also made using an image-forming apparatus making use of this charging roller. As a result, in a low-temperature and low-humidity environment (15° C. temperature, 10% humidity), faulty images caused by an increase in resistance of the charging member had occurred. Also, in the many-sheet image reproduction running test, image fogging due to toner adhesion had occurred.

Example 7

A charging roller was produced in the following way.

| | (by weight) |
|---|---|
| NBR (nitrile-butadiene rubber) | 100 parts |
| Lithium perchlorate | 5 parts |

-continued

| | (by weight) |
|---|---|
| Calcium carbonate | 30 parts |
| Zinc oxide | 5 parts |
| Fatty acid | 2 parts |

The above materials were kneaded for 10 minutes by means of an internal mixer controlled to 60° C., and thereafter 20 parts by weight of a plasticizer DOS (dioctyl sebacate) was added, based on 100 parts by weight of NBR, followed by further kneading for 20 minutes by means of the internal mixer, having been cooled to 20° C., to prepare a material compound. To this compound, 1 part by weight of sulfur as a vulcanizing agent and 3 parts by weight of Nocceler TS as a vulcanizing accelerator were added, based on 100 parts by weight of the material rubber NBR, followed by kneading for 10 minutes by means of a twin-roll mill cooled to 20° C. The resultant compound was molded by means of an extruder, which was so extruded around a stainless-steel support of 6 mm in diameter as to be in the shape of a roller After the heating-and-vulcanizing molding, the molded product was subjected to abrasion so as to have an outer diameter of 12 mm, thus an elastic layer was formed on the support.

On this elastic layer, a surface layer as shown below was formed by coating.

| | (by weight) |
|---|---|
| Polyurethane elastomer | 100 parts |
| Hydrophobic-treated conductive tin oxide particles (number-average particle diameter: 0.03 $\mu$m) | 40 parts |

As materials for the surface layer 2*c*, the above materials were dispersed and dissolved in a xylene/methyl isobutyl ketone (MIBK) mixed solvent to prepare a surface layer coating fluid. Using this coating fluid, it was coated by dip coating to form a surface layer with a layer thickness of 10 $\mu$m, thus a roller-shaped charging member (charging roller) was obtained.

In the present Example, ethylethoxysilane was used as the hydrophobic-treating agent. Also, as the hydrophobic-treating method, the (2) organic solvent method, described previously, was chosen. The hydrophobicity of the conductive tin oxide particles used in the present Example was 99%.

The coefficient of static friction $\mu s_B$ of the binder resin of the surface layer was 0.64, and the coefficient of static friction $\mu s$ of the charging roller surface was 0.90. Also, the ten-point average surface roughness Rz of the charging roller surface was 5.9 $\mu$m.

An evaluation was made on this charging roller in the same manner as in Example 1 to obtain the results shown in Tables 1 and 2. On images reproduced using an image-forming apparatus making use of this charging roller, coarse images had occurred on halftone images from the beginning.

Example 8

A charging roller was produced in the same manner as in Comparative Example 1 except that 0.5 part by weight of silicone oil was added in the surface layer of the charging roller for the purpose of making its coefficient of static friction small and the same tin oxide particles (number-average particle diameter: 0.03 $\mu$m) as those in Example 3, having been subjected to hydrophobic treatment, were used as the conducting agent. Incidentally, the hydrophobicity of the conductive tin oxide particles used in the present Example was 30%.

The coefficient of static friction $\mu s_B$ of the binder resin of the surface layer in the present Example was 0.71, and the coefficient of static friction $\mu s$ of the charging roller surface was 0.89. Also, the ten-point average surface roughness Rz of the charging roller surface was 6.2 $\mu$m.

An evaluation was made on this charging roller in the same manner as in Example 1 to obtain the results shown in Tables 1 and 2.

Comparative Example 2

A charging roller was produced in the same manner as in Example 2 except that titanium oxide particles not having been hydrophobic-treated was used in the surface layer and the layer was formed in a thickness of 40 $\mu$m. An evaluation was made similarly. The results obtained are shown in Tables 1 and 2.

The hydrophobicity of the conducting agent was 0%. The coefficient of static friction of the charging roller surface was 0.55, and the ten-point average surface roughness Rz was 2.8 $\mu$m.

Comparative Example 3

A charging roller was produced in the same manner as in Example 8 except that the silicone oil used in the surface layer was not used. Evaluation was made similarly. Results obtained are shown in Tables 1 and 2.

The hydrophobicity of the conducting agent was 30%. The coefficient of static friction of the charging roller surface was 1.07, and the ten-point average surface roughness Rz was 6.6 $\mu$m.

TABLE 1

| | | Environment: | | | | | |
|---|---|---|---|---|---|---|---|
| | | Environment 1 | | Environment 2 | | Environment 3 | |
| | Running test: | Initial stage | 15,000 sheets | Initial stage | 15,000 sheets | Initial stage | 15,000 sheets |
| Example: | | | | | | | |
| 1 | Image evaluation: | AA | AA | AA | A | AA | A |
| | Roller resistance (Ω): | $7.7 \times 10^5$ | $1.1 \times 10^6$ | $5.5 \times 10^5$ | $8.3 \times 10^5$ | $9.1 \times 10^5$ | $1.3 \times 10^6$ |
| 2 | Image evaluation: | AA | A | AA | A | AA | B |
| | Roller resistance (Ω): | $5.8 \times 10^5$ | $9.3 \times 10^5$ | $5.1 \times 10^5$ | $7.2 \times 10^5$ | $7.4 \times 10^5$ | $4.8 \times 10^6$ |
| 3 | Image evaluation: | AA | AA | AA | A | AA | A |
| | Roller resistance (Ω): | $6.8 \times 10^5$ | $8.8 \times 10^5$ | $6.3 \times 10^5$ | $7.9 \times 10^5$ | $9.3 \times 10^5$ | $2.2 \times 10^6$ |

TABLE 1-continued

| | | Environment: | | | | | |
|---|---|---|---|---|---|---|---|
| | | Environment 1 | | Environment 2 | | Environment 3 | |
| | Running test: | Initial stage | 15,000 sheets | Initial stage | 15,000 sheets | Initial stage | 15,000 sheets |
| 4 | Image evaluation: | AA | AA | AA | A | AA | A |
| | Roller resistance (Ω): | $7.5 \times 10^5$ | $9.0 \times 10^5$ | $6.0 \times 10^5$ | $7.8 \times 10^5$ | $9.0 \times 10^5$ | $2.0 \times 10^6$ |
| 5 | Image evaiuation: | A | A | A | A | A | B |
| | Roller resistance (Ω): | $1.5 \times 10^6$ | $3.9 \times 10^6$ | $9.2 \times 10^5$ | $9.8 \times 10^5$ | $4.6 \times 10^6$ | $7.3 \times 10^6$ |
| Comparative Example: | | | | | | | |
| 1 | Image evaluation: | AA | A | AA | A | AA | C |
| | Roller resistance (Ω): | $7.4 \times 10^5$ | $9.9 \times 10^5$ | $6.5 \times 10^5$ | $9.2 \times 10^5$ | $9.1 \times 10^5$ | $3.9 \times 10^8$ |
| Example: | | | | | | | |
| 6 | Image evaluation: | AA | A | AA | A | AA | B |
| | Roller resistance (Ω): | $5.5 \times 10^5$ | $9.8 \times 10^5$ | $3.8 \times 10^5$ | $8.1 \times 10^5$ | $9.7 \times 10^5$ | $7.9 \times 10^6$ |
| 7 | Image evaluation: | A | B | B | B | B | B |
| | Roller resistance (Ω): | $4.0 \times 10^6$ | $8.8 \times 10^6$ | $3.2 \times 10^6$ | $5.6 \times 10^6$ | $7.6 \times 10^6$ | $1.6 \times 10^7$ |
| 8 | Image evaluation: | A | A | A | A | A | B |
| | Roller resistance (Ω): | $7.9 \times 10^5$ | $8.9 \times 10^5$ | $5.6 \times 10^5$ | $7.1 \times 10^5$ | $9.6 \times 10^5$ | $1.8 \times 10^6$ |
| Comparative Example: | | | | | | | |
| 2 | Image evaluation: | AA | A | AA | A | A | c |
| | Roller resistance (Ω): | $4.7 \times 10^5$ | $1.8 \times 10^6$ | $3.8 \times 10^5$ | $7.9 \times 10^5$ | $7.1 \times 10^5$ | $7.8 \times 10^7$ |
| 3 | Image evaiuation: | A | A | A | A | A | B |
| | Roller resistance (Ω): | $7.5 \times 10^5$ | $9.8 \times 10^5$ | $5.1 \times 10^5$ | $8.5 \times 10^5$ | $1.0 \times 10^6$ | $6.9 \times 10^6$ |

TABLE 2

| | Environment 1 | | Environment 2 | | Environment 3 | |
|---|---|---|---|---|---|---|
| | Initial stage | 15,000 sheets | Initial stage | 15,000 sheets | Initial stage | 15,000 sheets |
| Example 1: | AA | A | AA | A | A | A |
| Example 2: | AA | A | AA | A | A | B |
| Example 3: | AA | AA | AA | AA | AA | A |
| Example 4: | AA | AA | AA | A | AA | A |
| Example 5: | AA | AA | AA | A | AA | A |
| Comparative Example 1: | AA | B | AA | B | AA | C |
| Example 6: | AA | B | A | B | A | B |
| Example 7: | A | B | A | B | B | B |
| Example 8: | AA | A | AA | B | AA | B |
| Comparative Example 2: | AA | A | AA | A | A | C |
| Comparative Example 3: | AA | B | AA | B | A | C |

As described above, according to the present invention, the toner may adhere less to the charging roller surface, and hence any image fog and uneven image density due to such adhesion of toner does not occur. As the result, the image-forming apparatus can print on a greatly larger number of sheets in total and can be improved in running stability. Also, even in a low-temperature and low-humidity environment, any image fog due to toner adhesion does not occur. Still also, in the charging roller that charges the charging object member by the contact charging system under application of only DC voltage to the charging member, the increase in resistance (charge-up) of the charging member as a result of continuous use little occurs. Hence, the charge potential of the charging object member surface can stably be obtained over a long period of time. Thus, by using the conducting member of the present invention in image-forming apparatus, a high image quality can be maintained over a long period of time.

What is claimed is:

1. A conducting member which is disposed in contact with an electrophotographic photosensitive member and to which a voltage is to be applied, the conducting member comprising;

a support and a coating layer formed on the support;

said coating layer containing a conducting agent having been subjected to surface treatment, and the surface of said conducting member having a coefficient of static friction of 1.0 or lower.

2. A conducting member according to claim 1, wherein the voltage to be applied is only a direct-current voltage.

3. A conducting member according to claim 1, wherein said coating layer is a surface layer.

4. A conducting member according to claim 3, further comprising an elastic layer, wherein said surface layer is formed on the elastic layer.

5. A conducting member according to claim 1, wherein the coefficient of static friction is 0.01 or higher.

6. A conducting member according to claim 1 or 5, wherein the coefficient of static friction is 0.5 or lower.

7. A conducting member according to claim 1, wherein said conducting agent having been subjected to surface treatment has a number-average particle diameter of from 0.001 μm to 1.0 μm.

8. A conducting member according to claim 1, wherein said coating layer contains the conducting agent having been subjected to surface treatment and a binder resin, and the conducting agent and the binder resin are in a proportion of from 0.1:1.0 to 2.0:1.0 in weight ratio.

9. A conducting member according to claim 1, wherein said surface treatment is hydrophobic treatment.

10. A conducting member according to claim 9, wherein said hydrophobic treatment is treatment with a coupling agent.

11. A conducting member according to claim 9, wherein said hydrophobic treatment provides a hydrophobicity of from 20% to 98%.

12. A conducting member according to claim 1, which has a surface roughness of 10 $\mu$m or smaller as ten-point average surface roughness.

13. A conducting member according to claim 1, which is a charging member.

14. A process cartridge comprising:

an electrophotographic photosensitive member and a conducting member disposed in contact with the electrophotographic photosensitive member and to which a voltage is to be applied;

said electrophotographic photosensitive member and conducting member being supported as one unit and being detachably mountable to the main body of an electrophotographic apparatus;

said conducting member comprising a support and a coating layer formed on the support;

said coating layer containing a conducting agent having been subjected to surface treatment, and the surface of said conducting member having a coefficient of static friction of 1.0 or lower.

15. A process cartridge according to claim 14, wherein the voltage to be applied is only a direct-current voltage.

16. A process cartridge according to claim 14, wherein said coating layer is a surface layer.

17. A process cartridge according to claim 16, wherein said conducting member has an elastic layer, wherein said surface layer is formed on the elastic layer.

18. A process cartridge according to claim 14, wherein the coefficient of static friction is 0.01 or higher.

19. A process cartridge according to claim 14 or 18, wherein the coefficient of static friction is 0.5 or lower.

20. A process cartridge according to claim 14, wherein said conducting agent having been subjected to surface treatment has a number-average particle diameter of from 0.001 $\mu$m to 1.0 $\mu$m.

21. A process cartridge according to claim 14, wherein said coating layer contains the conducting agent having been subjected to surface treatment and a binder resin, and the conducting agent and the binder resin are in a proportion of from 0.1:1.0 to 2.0:1.0 in weight ratio.

22. A process cartridge according to claim 14, wherein said surface treatment is hydrophobic treatment.

23. A process cartridge according to claim 22, wherein said hydrophobic treatment is treatment with a coupling agent.

24. A process cartridge according to claim 22, wherein said hydrophobic treatment provides a hydrophobicity of from 20% to 98%.

25. A process cartridge according to claim 14, wherein said conducting member has a surface roughness of 10 $\mu$m or smaller as ten-point average surface roughness.

26. A process cartridge according to claim 14, wherein said conducting member is a charging member.

27. A process cartridge according to claim 14, wherein said electrophotographic apparatus employs a cleaning-at-development system.

28. An image-forming apparatus comprising:

an electrophotographic photosensitive member and a conducting member disposed in contact with the electrophotographic photosensitive member and to which a voltage is to be applied;

said conducting member comprising a support and a coating layer formed on the support;

said coating layer containing a conducting agent having been subjected to surface treatment, and the surface of said conducting member having a coefficient of static friction of 1.0 or lower.

* * * * *

UNITED STATES PATENT AND TRADEMARK OFFICE

CERTIFICATE OF CORRECTION

PATENT NO. : 6,400,919 B1
DATED : June 4, 2002
INVENTOR(S) : Hiroshi Inoue et al.

It is certified that error appears in the above-identified patent and that said Letters Patent is hereby corrected as shown below:

Column 3,
Line 21, "support;" should read -- support; and --.
Line 33, "support;" should read -- support; and --.

Column 9,
Line 15, "<60" should read -- ≤60 --.
Line 58, "the" should read -- a --.

Column 11,
Line 11, "the" should be deleted.

Column 14,
Line 11, "these" should read -- these elements --.
Line 19, "in used" should read -- used in --.
Line 21, "55*" should read -- 55% --.
Line 36, "the" (first occurrence) should read -- a --.

Column 16,
Line 3, "the" should be deleted.
Line 51, "Results" should read -- The results --.

Column 19,
Line 22, "roller" should read -- roller. --.

Column 20,
Line 33, "was" should read -- were --.
Line 45, "Results" should read -- The results --.

Column 22,
Line 34, "ing;" should read -- ing: --.

UNITED STATES PATENT AND TRADEMARK OFFICE

CERTIFICATE OF CORRECTION

PATENT NO. : 6,400,919 B1
DATED : June 4, 2002
INVENTOR(S) : Hiroshi Inoue et al.

It is certified that error appears in the above-identified patent and that said Letters Patent is hereby corrected as shown below:

Column 23,
Line 16, "support;" should read -- support; and --.

Column 24,
Line 29, "support;" should read -- support; and --.

Signed and Sealed this

Twenty-ninth Day of April, 2003

JAMES E. ROGAN
*Director of the United States Patent and Trademark Office*